US005934002A

United States Patent [19]

Blanchet

[11] Patent Number: 5,934,002

[45] Date of Patent: Aug. 10, 1999

[54] EMPTY SHELL COLLECTOR FOR FIRE ARM

[75] Inventor: Robert Blanchet, Canadian Forces Base Borden, Canada

[73] Assignee: Her Majesty the Queen in right of Canada, as represented by the Minister of National Defence, Ottawa, Canada

[21] Appl. No.: 09/037,427

[22] Filed: Mar. 10, 1998

[30] Foreign Application Priority Data

Mar. 25, 1997 [CA] Canada ..... 2200922

[51] Int. Cl.[6] ..... F41A 15/12

[52] U.S. Cl. ..... 42/98

[58] Field of Search ..... 42/98

[56] References Cited

U.S. PATENT DOCUMENTS

| | | | |
|---|---|---|---|
| D. 297,346 | 8/1988 | MacKenzie et al. | 42/98 |
| 663,262 | 12/1900 | Dieterich | 42/98 |
| 2,866,289 | 12/1958 | Wilcox | 42/98 |
| 3,153,296 | 10/1964 | Hofstetter | 42/98 |
| 4,028,834 | 6/1977 | Dobson | 42/98 |
| 4,166,333 | 9/1979 | Krater | 42/98 |
| 4,334,975 | 6/1982 | Olson | 42/98 |
| 4,594,803 | 6/1986 | Muncy | 42/98 |
| 4,715,141 | 12/1987 | Kohnke et al. | 42/98 |
| 4,903,426 | 2/1990 | Bamimate et al. | 42/98 |
| 5,138,787 | 8/1992 | Riddle et al. | 42/98 |
| 5,285,593 | 2/1994 | Bammate et al. | 42/98 |
| 5,398,439 | 3/1995 | Harless | 42/98 |

*Primary Examiner*—Charles T. Jordan
*Assistant Examiner*—Denise J Buckley
*Attorney, Agent, or Firm*—Larson & Taylor

[57] ABSTRACT

A device for receiving and collecting spent shells ejected from a firearm having an spent shell ejection port. The invention comprises a hollow conduit which is shaped analogous to and surrounding the natural ejection path of the shell casings when mounted at the ejection port of the firearm by fastening clips. The ejected empty shells are collected in a receiving container attached to a flexible tubing which is attached to the conduit. An extension device for the cocking handle of the firearm may be required which improves handling of the weapon when the spent shell collector is installed.

11 Claims, 4 Drawing Sheets

EMPTY SHELL COLLECTOR FOR FIRE ARM

FIELD OF THE INVENTION

The invention described herein relates generally to a device for attachment to an automatic and semi-automatic firearm for receiving and collecting spent shells ejected from the firearm.

BACKGROUND OF THE INVENTION

The automatic and semi-automatic rifles such as M16 and AR15 made by Colt Company in the U.S. and their Canadian modifications such as C9 and C7 rifles have an ejection port adjacent to the loading system for ejecting spent shell casings after each firing.

The M16 and C9 rifles are used aboard helicopters and ships. The ejection and spill of the empty shells on to the floor of the aircraft and ship can create hazards, for example the empty shells could get ingested into the aircraft engine. This situation is referred to in flight safety as Foreign Object Damage (FOD).

To resolve the spill-out problems, several shell catchers available in the market were considered and tested on the C9 rifle, but none of them were satisfactory. The problems encountered in using the shell catchers related to the restriction in the handling of the weapon itself, incompatibility of types of attachments, size, weight, and most important, improper flow of the empty shells and blockage of the system.

In one of these devices described in U.S. Pat. No. 5,389,439 the empty shell casing is attached to a support plate or, a latching bracket which fits against one side of the loading handle with a locking mechanism. The empty shell catcher is then fixed in the position adjacent to the discharge port of the firearm. In this device, the empty shells collected in the shell catcher are emptied by detachment of the container from its support.

In another device of a different type the spent shell collector consists of a bag with a bottom opening which is closed by a snap fastener. The bag is attached to the firearm with a bracket which covers the empty shell ejection port.

One major disadvantages of the prior art systems is that, the integrity of the natural ejection pathway of the shells is not considered. The ejected spent shells are forced through a pathway into the empty shell container. As a result clogging of the pathway can occur. Another disadvantage is that the mounting bracket of these systems interfere with the operation of the cocking handle in C9 and C7 rifles.

SUMMARY OF THE INVENTION

It is the object of the present invention to provide a spent shell collector for firearms and in particular the M16 and C9 types which can be conveniently mounted at the ejection port for empty shells, eliminating potential hazards associated with the ejection of the empty shells.

An empty shell collector according to one embodiment of the present invention comprises: a hollow conduit for mounting at an ejection port for spent shells which is shaped analogous to and surrounding the natural ejection path of the shell casings when mounted at the spent shell ejection port of the firearm with an input opening of the conduit surrounding the ejection port; and, a receiving container for holding the shell casings coupled to an output of the conduit.

In one embodiment, the receiving container is coupled to the conduit with a flexible corrugated tubing to accommodate the passage of the empty shells to the receiving container. In another embodiment of the invention, the conduit is mounted on the firearm with mounting clips. In a further embodiment of the invention, the conduit has perforations of small diameters to allow only the escape of smoke and heat.

With the shell collector mounted on a firearm such as the M16 and C9 rifles, an extension device may be required for the cocking handle of the rifle since the ejection port area is kept covered. This extension device for the cocking handle is made larger than the original to facilitate handling the firearm with gloves, in cold environments.

This extension device for the handle also provides for reduced length of pull which facilitates firing the weapon from the shoulder.

DESCRIPTION OF THE DRAWINGS

The invention will now be described with reference to the accompanying drawings.

DESCRIPTION OF THE PREFERRED EMBODIMENT

The C9 rifle With its normal configuration and design, ejects the expended shells and retaining clips on the ground. This may present no hazard when operating the rifle on the ground. However, when the rifle is used on board of a military helicopter the ejected shells and clips could create hazardous conditions; for example, if they are ingested into the helicopter engine or, projected at air crew.

Various spent shell collectors available in the market were tried and found to be not satisfactory. The problems associated with using these prior art shell collectors were restriction of the handling of the weapon itself, incompatibility of types of attachments, size, weight, and most important, improper flow of the spent shells resulting in blockage of the system.

Figure 1:
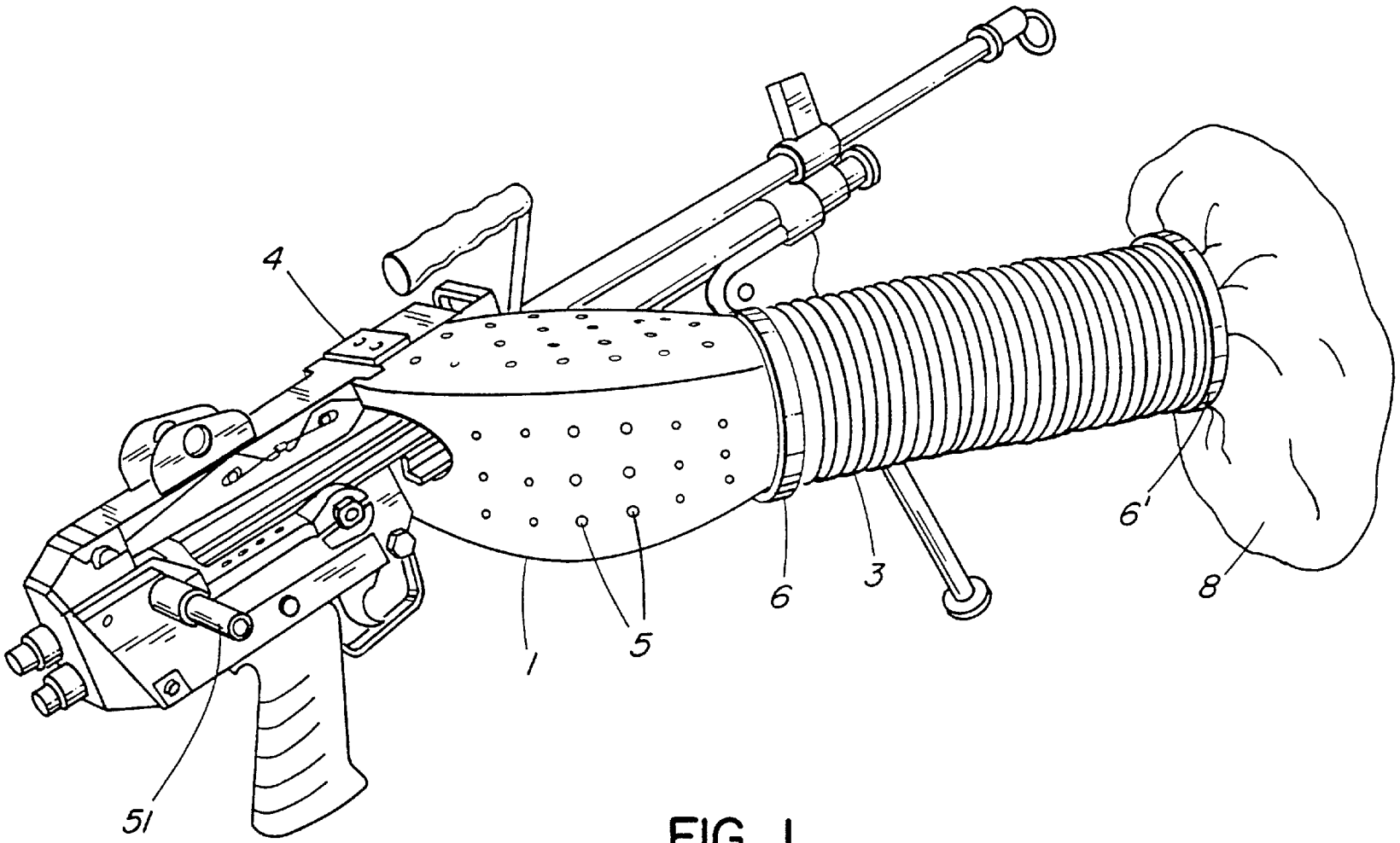
FIG. 1 illustrates the installed conduit with a flexible tubing coupling the receiving container to the conduit, according to one embodiment of the invention.
Figure 2:
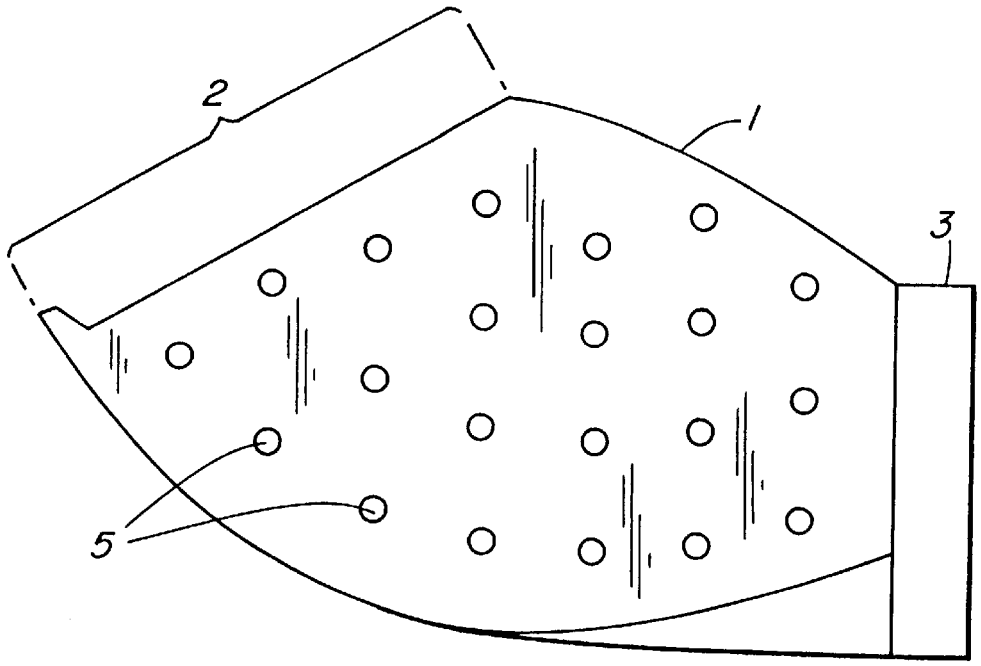
FIG. 2 illustrates the top view of a metal conduit that forms part of a shell collector.

The system of this invention as shown in FIG. 1 is designed such that: an inlet 2 of a conduit 1 covers the ejection port of a C9 rifle. As illustrated, conduit 1 extends forwardly of the ejection port, and has a shape conforming to and surrounding the natural ejection path of spent shells when they are ejected from the rifle. The conduit 1 is installed on the rifle preferably using ammunition box mounting clips 4.

The surface of the conduit has perforations 5 of small size to allow only heat and smoke to escape, and air to cool down the ejection port area. The cylindrical end of the conduit 1 is connected to a corrugated flexible tubing 3, using a hose clamp 6. The other end of the flexible tubing is connected to a spent shell recovery container 8. The spent shell recovery container may be in various forms preferably a soft walled bag connected to the corrugated tubing 3 by a hose clamp 6, but it could also be a solid walled container. This whole spent shell collection system is lightweight and easily installed.

Figure 3:
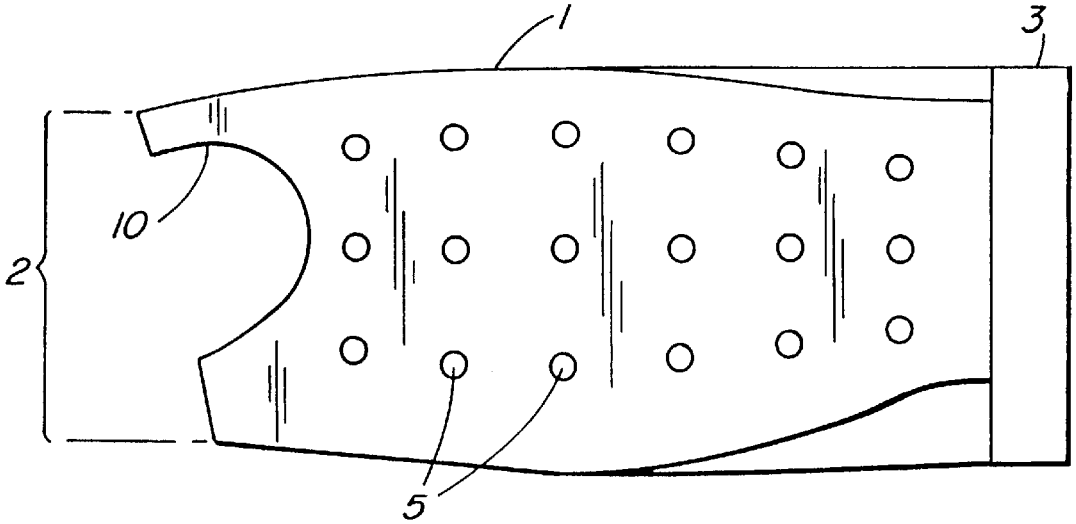
FIG. 3 illustrates the side view of the metal conduit.
Figure 4:
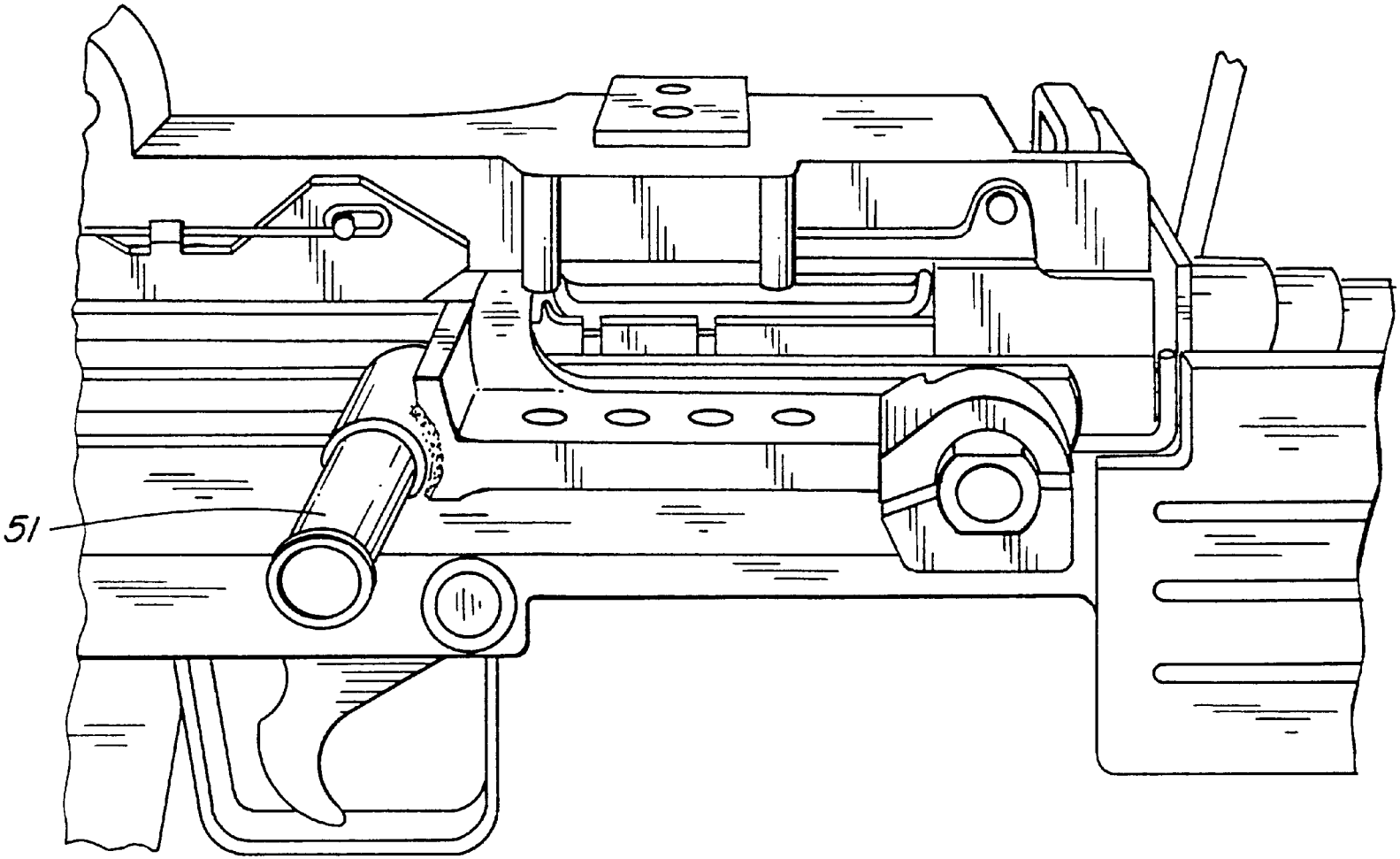
FIG. 4 illustrates the extension mechanism for the cocking handle, installed, without the shell collector.
Figure 5:
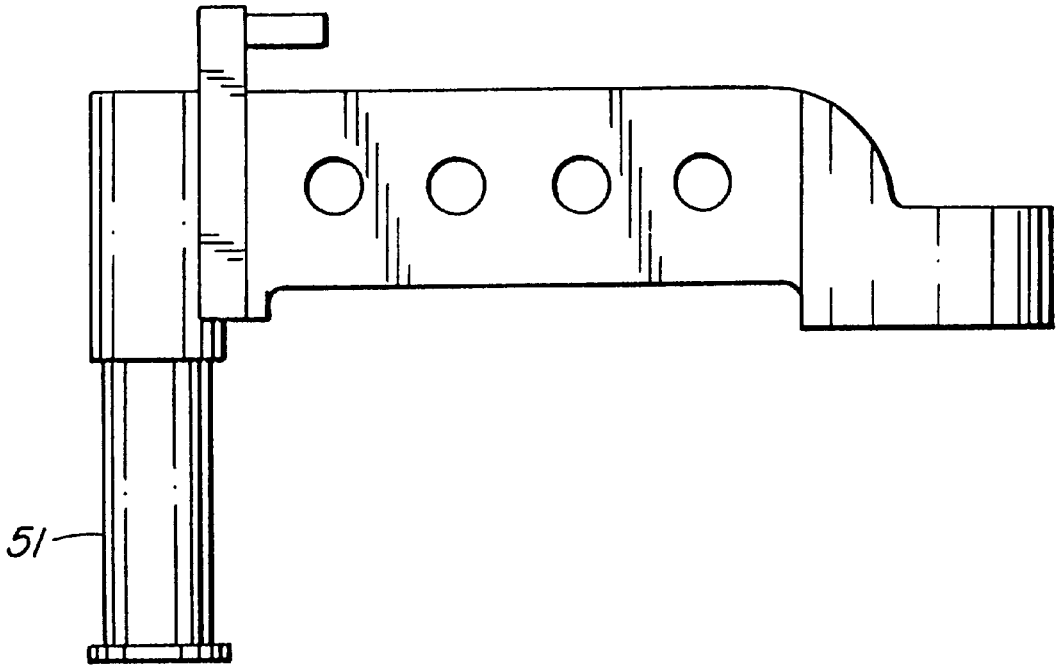
FIG. 5 illustrates a top view of the extension mechanism.
Figure 6:
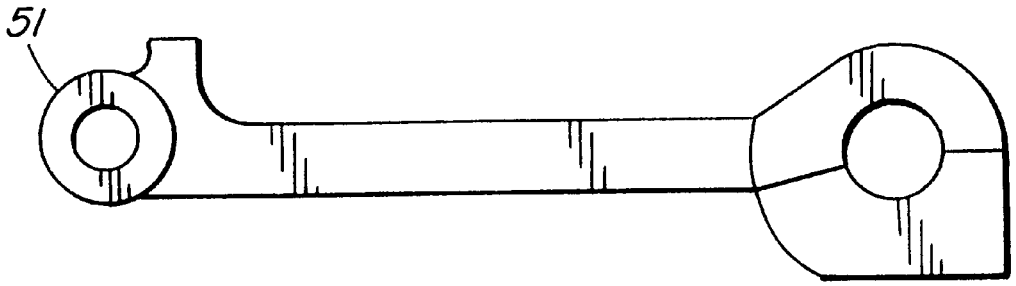
FIG. 6 illustrates a side view of the extension mechanism.

Even though the conduit is quickly removable, its removal would be inappropriate in case of a jamming problem during firing. The solution was found by notching the conduit, as shown in FIG. 3 at 10, and adding an extension to the cocking handle 51 as shown in FIG. 4 to 6 to allow proper handling of the firearm while maintaining the ejection port area covered at all times. The extended cocking handle shown in FIG. 5 at 51 is also made larger in size to facilitate its handling while wearing gloves in cold environments. By extending the cocking handle to the rear, the overall length of pull is being reduced which improves the firing of the weapon from the shoulder, a problem well known to military, infantry personnel.

The advantage of this invention, over the prior art, consists in using the natural ejection path of the spent shells to design a conduit of adequate size and shape to enable the escape of the spent shells and allow a free flow through a flexible tubing into the shell recovery container. This design is a unique solution to existing problems:

- it allows the spent shells to follow their natural ejection path into the recovery bag;
- the surface perforation of the conduit, an important feature, allows dissipation of heat and smoke and allows air cooling of the firearm;
- the conduit may be constructed and moulded from high temperature resistant polymer or from a metal that is strong and matches the colour of the firearm;
- the conduit is fastened to the firearm with clips instead of being screwed on the firearm;
- for the purpose of emptying the receiving container, only the receiving container need to be removed; and,
- the new extended cocking handle improves the length of pull and the grip and no alterations are done to the weapon for its installation.

Various modifications may be made to the preferred embodiments without departing from the spirit and scope of the invention as defined in the appended claims.

What is claimed is:

1. A collection system for receiving and collecting spent shell casings from a firearm wherein the firearm has a breech block for receiving and firing cartridges that include a shell casing, and the breech block has an ejection port for discharging spent shell casings, said collection system comprising: a hollow conduit, which has an inlet and an outlet, the conduit being installable on the firearm with the inlet next to the ejection port and, when installed, extending forwardly of the ejection port and being configured to correspond in curvature to trajectories of shell casings ejected from the firearm and to surround a path followed by spent shell casings when injected; the collector system further including a collector means coupled to the outlet of the conduit for receiving and holding the spent shell casings which pass through the conduit.

2. A device as defined in claim 1, wherein the conduit is adapted to be removably attached to said breech block so that its inlet is positioned to surround the ejection port when the conduit is attached to the breech block.

3. A device as defined in claim 1, wherein the conduit is removably attached on the breech block of the firearm with mounting clips.

4. A device as defined in claim 2, wherein the conduit is removably attached on the breech block of the firearm with mounting clips.

5. A device as defined in claim 1, wherein a surface of the conduit has small perforations to allow only the escape of smoke and heat.

6. A device as defined in claim 2, wherein the surface of the conduit has small perforations to allow only the escape of smoke and heat.

7. A device as defined in claim 3, wherein the surface of the conduit has small perforations to allow only the escape of smoke and heat.

8. A firearm with a breech block having a cocking mechanism, with an extended cocking handle attached to the said cocking mechanism to permit cocking the firearm from outside of the conduit, when the conduit described in claim 1 is installed over the ejection port for the spent shell casings, wherein an edge of a side surface of the conduit adjacent the breech block and facing the cocking handle is notched, which notch is of a size to allow for proper handling of the cocking mechanism.

9. A firearm with a breech block having a cocking mechanism, with an extended cocking handle attached to the said cocking mechanism to permit cocking the firearm from outside of the conduit, when the conduit described in claim 2 is installed over the ejection port for the spent shell casings, wherein an edge of a side surface of the conduit adjacent the breech block and facing the cocking handle is notched, which notch is of a size to allow for proper handling of the cocking mechanism.

10. A firearm with a breech block having a cocking mechanism, with an extended cocking handle attached to the said cocking mechanism to permit cocking the firearm from outside of the conduit, when the conduit described in claim 3 is installed over the ejection port for the spent shell casings, wherein an edge of a side surface of the conduit adjacent the breech block and facing the cocking handle is notched, which notch is of a size to allow for proper handling of the cocking mechanism.

11. A firearm with a breech block having a cocking mechanism, with an extended cocking handle attached to the said cocking mechanism to permit cocking the firearm from outside of the conduit, when the conduit described in claim 4 is installed over the ejection port for the spent shell casings, wherein an edge of a side surface of the conduit adjacent the breech block and facing the cocking handle is notched, which notch is of a size to allow for proper handling of the cocking mechanism.

* * * * *